US010683702B2

(12) United States Patent
Conger et al.

(10) Patent No.: US 10,683,702 B2
(45) Date of Patent: Jun. 16, 2020

(54) ROTARY STEERABLE SYSTEM HAVING ACTUATOR WITH LINKAGE

(71) Applicant: Weatherford Technology Holdings, LLC, Houston, TX (US)

(72) Inventors: Robert G. Conger, Houston, TX (US); Steven Reid Farley, Magnolia, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 117 days.

(21) Appl. No.: 15/796,844

(22) Filed: Oct. 29, 2017

(65) Prior Publication Data

US 2019/0128071 A1 May 2, 2019

(51) Int. Cl.

| | |
|---|---|
| ***E21B 7/06*** | (2006.01) |
| ***E21B 17/10*** | (2006.01) |
| ***E21B 34/06*** | (2006.01) |
| ***E21B 44/00*** | (2006.01) |
| ***E21B 47/022*** | (2012.01) |
| ***E21B 47/024*** | (2006.01) |
| *E21B 47/12* | (2012.01) |

(52) U.S. Cl.

CPC ..... *E21B 7/067* (2013.01); *E21B 7/06* (2013.01); *E21B 17/1014* (2013.01); *E21B 34/06* (2013.01); *E21B 44/005* (2013.01); *E21B 47/022* (2013.01); *E21B 47/024* (2013.01); *E21B 47/12* (2013.01)

(58) Field of Classification Search

CPC combination set(s) only.

See application file for complete search history.

(56) References Cited

U.S. PATENT DOCUMENTS

| | | | | |
|---|---|---|---|---|
| 4,185,704 | A * | 1/1980 | Nixon, Jr. | E21B 7/068 175/325.2 |
| 5,094,304 | A | 3/1992 | Briggs | |
| 5,242,020 | A | 9/1993 | Cobern | |
| 5,553,678 | A | 9/1996 | Barr et al. | |
| 6,116,354 | A | 9/2000 | Buytaert | |
| 6,148,933 | A | 11/2000 | Hay et al. | |
| 7,762,356 | B2 | 7/2010 | Turner et al. | |
| 8,011,452 | B2 | 9/2011 | Downton | |
| 8,104,548 | B2 | 1/2012 | Ma et al. | |
| 8,157,024 | B2 | 4/2012 | de Paula Neves et al. | |

(Continued)

OTHER PUBLICATIONS

Int'l ISRWO received in copending PCT Application No. PCT/US2018/050074 dated Dec. 4, 2018, 11 pages.

*Primary Examiner* — George S Gray

(74) *Attorney, Agent, or Firm* — Blank Rome LLP

(57) ABSTRACT

An apparatus disposed on a drillstring deviates a borehole advanced by a drill bit. At least one director is disposed on a housing to rotate therewith. The director at least includes a piston movable in a chamber, a pad pivotable about a pivot point between an extended condition and a retracted condition relative to the housing, and a linkage arm pivotably connected between the piston and the pad. At least one actuator disposed on the housing in fluid communication with a housing bore is operable at least between a first condition (directing communicated fluid from the bore or other source to the chamber of the director) and a second condition (at least permitting the director to retract toward the retracted condition).

26 Claims, 7 Drawing Sheets

(56) References Cited

U.S. PATENT DOCUMENTS

| | | | | |
|---|---|---|---|---|
| 8,474,552 | B2 | 7/2013 | de Paula Neves et al. | |
| 8,763,726 | B2 | 7/2014 | Johnson et al. | |
| 9,140,074 | B2 | 9/2015 | Schwefe et al. | |
| 2006/0185902 | A1* | 8/2006 | Song | E21B 7/06 175/61 |
| 2009/0260884 | A1 | 10/2009 | Santelmann | |
| 2011/0139513 | A1 | 6/2011 | Downton | |
| 2011/0147089 | A1 | 6/2011 | Kulkarni et al. | |
| 2012/0273238 | A1* | 11/2012 | Boekholtz | E21B 7/04 166/383 |
| 2013/0068479 | A1* | 3/2013 | AlDossary | E21B 23/14 166/381 |
| 2013/0105149 | A1* | 5/2013 | Williamson, Jr. | E21B 34/06 166/250.01 |
| 2014/0209389 | A1 | 7/2014 | Sugiura et al. | |
| 2014/0262507 | A1* | 9/2014 | Marson | E21B 7/10 175/24 |
| 2016/0002978 | A1 | 1/2016 | Rushton | |
| 2016/0084007 | A1* | 3/2016 | Sugiura | E21B 7/06 175/61 |
| 2016/0326805 | A1 | 11/2016 | Gao | |

* cited by examiner

ROTARY STEERABLE SYSTEM HAVING ACTUATOR WITH LINKAGE

FIELD OF THE DISCLOSURE

The subject matter of the present disclosure relates to an apparatus and method for controlling a downhole assembly. The subject matter is likely to find its greatest utility in controlling a steering mechanism of a downhole assembly to steer a drill bit in a chosen direction, and most of the following description will relate to steering applications. It will be understood, however, that the disclosed subject matter may be used to control other parts of a downhole assembly.

BACKGROUND OF THE DISCLOSURE

When drilling for oil and gas, it is desirable to maintain maximum control over the drilling operation, even when the drilling operation may be several kilometers below the surface. Steerable drill bits can be used for directional drilling and are often used when drilling complex borehole trajectories that require accurate control of the path of the drill bit during the drilling operation.

Directional drilling is complicated because the steerable drill bit must operate in harsh borehole conditions. For example, the steering mechanism must reliably operate under exceptional heat, pressure, and vibration conditions that will typically be encountered during the drilling operation. Additionally, the steering mechanism is typically disposed near the drill bit, and the desired real-time directional control of the steering mechanism is remotely controlled from the surface. Regardless of its depth within the borehole, the steering mechanism must maintain the desired path and direction and must also maintain practical drilling speeds.

Many types of steering mechanism are used in the industry. A common type of steering mechanism has a motor disposed in a housing with a longitudinal axis that is offset or displaced from the axis of the borehole. The motor can be of a variety of types including electric and hydraulic. Hydraulic motors that operate using the circulating drilling fluid are commonly known as a "mud" motors.

The laterally offset motor housing, commonly referred to as a bent housing or "bent sub", provides lateral displacement that can be used to change the trajectory of the borehole. By rotating the drill bit with the motor and simultaneously rotating the motor housing with the drillstring, the orientation of the housing offset continuously changes, and the path of the advancing borehole is maintained substantially parallel to the axis of the drillstring. By only rotating the drill bit with the motor without rotating the drillstring, the path of the borehole is deviated from the axis of the non-rotating drillstring in the direction of the offset on the bent housing.

Another steering mechanism is a rotary steerable tool that allows the drill bit to be moved in any chosen direction. In this way, the direction (and degree) of curvature of the borehole can be determined during the drilling operation, and can be chosen based on the measured drilling conditions at a particular borehole depth.

A common way to deflect a rotary steerable tool is to use a piston to energize a pad. The pad pushes against the formation in order to generate bit side force to deviate the wellbore. Problems occur due to relative motion at the interface between the pad and the piston, and the relative motion results in abrasion and galling damage to both surfaces as well as "cocking" loads on the piston.

Although various steering mechanisms are effective, operators are continually looking for faster, more powerful, reliable, and cost effective directional drilling mechanisms and techniques. The subject matter of the present disclosure is directed to such an endeavor.

SUMMARY OF THE DISCLOSURE

According to the present disclosure, an apparatus is disposed on a drillstring for deviating a borehole advanced by a drill bit. The apparatus comprises a housing, at least one director, and at least one actuator. The housing is disposed on the drillstring and transfers rotation to the drill bit. For example, the housing can have the rotation imparted to it by the drillstring, by a motor disposed on the drillstring, or by both the drillstring and the motor.

The at least one director is disposed on the housing to rotate therewith so that the at least one director rotates about the advancing borehole as the housing rotates. The at least one director at least includes a piston, a pad, and a linkage arm. The piston is movable in a chamber defined in the housing, module, or other component associated with the apparatus. The pad is pivotable about a pivot point between an extended condition and a retracted condition relative to the housing. For example, a pivot pin can connect an edge of the pad to the housing, module, or other component associated with the apparatus.

Finally, the linkage arm is pivotably connected between the piston and the pad so the linkage arm can transfer the movement of the piston in the chamber to pivot of the pad about the pivot point. For example, the piston can include a first linkage pin connected to a first end of the linkage arm, while the pad can have a second linkage pin connected to a second end of the linkage arm. Geometrically speaking, the first and second linkage pins and the pivot point can be parallel to a center of rotation of the housing, while the linkage can lie in a plane perpendicular to the center of rotation.

During movement, the piston can move between first and second positions in the chamber in a radial direction relative to a center of rotation of the housing. The linkage movable with the piston can then rotate relative to the pivot point from a first angular orientation at the first position to a second angular orientation at the second position. The second angular orientation can be more aligned with radial direction than the first angular orientation. Accordingly, the first pivot pin may be translated radially in the radial direction with the piston, while the second pivot pin may be rotated about the pivot point.

The at least one actuator is disposed on the housing in fluid communication with communicated fluid, which can be form the bore, from a hydraulic system, or other source. As the apparatus advances the borehole, the at least one actuator is operable at least between a first condition (directing the communicated fluid to the chamber of the at least one director) and a second condition (at least permitting the at least one director to retract toward the retracted condition). For example, the at least one actuator can include a valve member and a drive. The valve member may be movable (e.g., rotatable) relative to an inlet port and an outlet port. The drive being operable to move (e.g., rotate) the valve member can move (e.g., rotate) the valve member in a first orientation directing the communicated fluid or in a second orientation closing off the communication of fluid. (The inlet port can be disposed in fluid communication with the communicated fluid from the bore of the housing or from a hydraulic source.) If needed, the communicated fluid of the at least one director can be vented, which can at least permit the at least one director to retract toward the retracted condition. For example, the chamber can define a vent to communicate with the borehole.

The apparatus can comprise a controller that operates the at least one actuator. For example, the controller can be configured to determine angular orientation of the at least one director relative to a desired trajectory for the borehole and can be configured to translate the determined orientation to actuations of the at least one actuator to deviate the borehole toward the desired trajectory. For example, the controller can have various sensors and electronics for determining angular orientation of the at least one director of the housing relative to a reference (such as toolface), and the controller can store and/or communicate desired trajectory information. The controller and/or the at least one actuator may rotate with the housing, although other arrangements can be used.

The at least one director can comprise a module removably positionable in a side of the housing. In this way, the module can hold the piston, the pad, the linkage, and the pivot point, and the module can define the chamber with a channel for communicating adjacent the at least one actuator. The module can facilitate assembly and can allow different arrangements of the piston, the pad, the linkage, and the like to be used with housings of different sizes, configurations, etc.

The piston can have a seal disposed about the piston that slideably engages an inside wall of the chamber. For example, the seal may be a metal sealing ring that forms a metal-to-metal seal with the chamber wall. For assembly, the piston can include a central socket affixed in an outer piston body. The central socket is connected to the linkage arm, and the outer piston body has the seal disposed thereabout.

A drilling method according to the present disclosure comprises advancing a borehole with a drill bit on a rotating drilling assembly coupled to a drillstring by transferring rotation of the rotating drilling assembly to the drill bit; controlling fluid in the rotating drilling assembly by operating at least one actuator disposed on the rotating drilling assembly; moving a piston in a radial direction on the rotating drilling assembly using the controlled fluid from the at least one operated actuator; transferring the movement of the piston with a linkage arm to a pad disposed on the rotating drilling assembly; pivoting the pad about a pivot point on the rotating drilling assembly with the transferred movement from the linkage arm; and deviating the advancing borehole with the rotating drilling assembly using the pivoted pad.

Operating the at least one actuator and controlling the fluid can involve measuring an angular rate of the rotating drilling assembly as it rotates; measuring orientation of the rotating drilling assembly as it rotates relative to the borehole; taking a desired trajectory for the borehole; and translating the desired trajectory into the actuation of the at least one actuator based on the angular rate and the orientation of the rotating drilling assembly.

To control the fluid using the at least one operated actuator, a portion of the flow through the rotating drilling assembly can be directed to the piston by operating a valve. For example, operating the valve can involve moving (e.g., rotating) a valve member relative to an inlet port and an outlet port with a drive operable to move (e.g., rotate) the valve member. The valve member in a first orientation can direct the controlled fluid, whereas the valve member in a second orientation can close off the controlled fluid. The valve can communicate with the controlled fluid from a bore of the rotating drilling assembly or from a hydraulic source. If necessary, the communicated fluid of the at least one director can be vented to at least permit the at least one director to retract toward the retracted condition.

To transfer the movement of the piston with the linkage arm to the pad disposed on the rotating drilling assembly, the movement of the piston can be transferred with a first linkage pin connected to the piston at a first end of the linkage arm to a second linkage pin connected to the pad at a second end of the linkage arm. The piston can move between first and second positions in the radial direction relative to a center of rotation of the housing, and the linkage can rotate relative to the pivot point from a first angular orientation at the first position to a second angular orientation at the second position. The second angular orientation can be more aligned with radial direction than the first angular orientation. Thus, while transferring the movement of the piston with the linkage arm to the pad disposed on the rotating drilling assembly, the first linkage pin can translate in the radial direction with the piston, and the second linkage pin can rotate about the pivot point.

Transferring rotation of the rotating drilling assembly to the drill bit can involve imparting the rotation to the housing by the drillstring, by a motor disposed on the drillstring, or by both the drillstring and the motor. Finally, controlling at least some of the flow through the rotating drilling assembly by operating the at least one actuator disposed on the rotating drilling assembly can involve determining angular orientation of the at least one director relative to a desired trajectory for the borehole and translating the determined orientation to the actuations of the at least one actuator to deviate the borehole toward the desired trajectory.

The foregoing summary is not intended to summarize each potential embodiment or every aspect of the present disclosure.

DETAILED DESCRIPTION OF THE DISCLOSURE

Figure 1A:
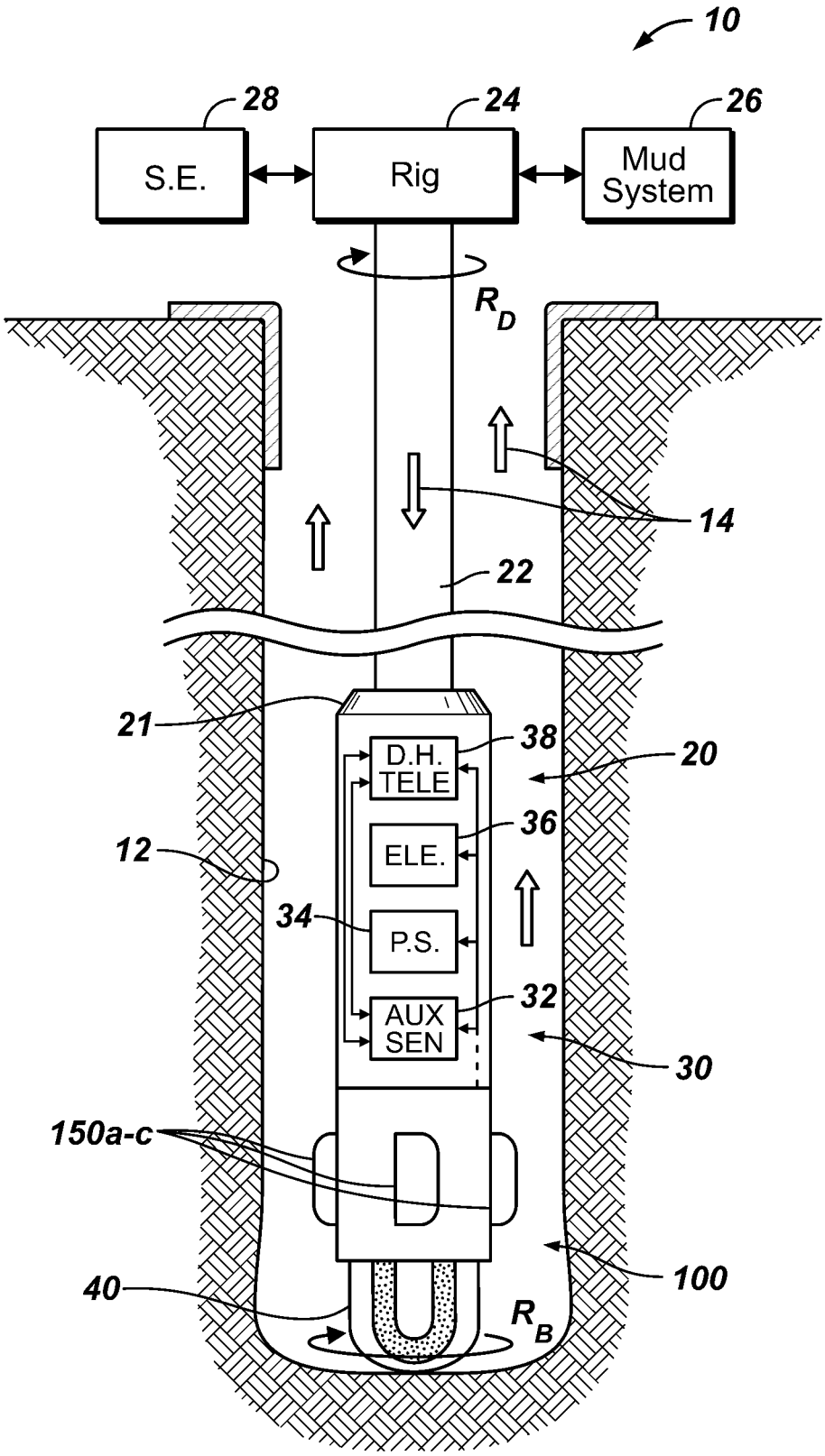
FIGS. 1A-1B schematically illustrate a drilling system incorporating a steering apparatus according to the present disclosure.

FIG. 1A schematically illustrates a drilling system 10 incorporating a rotating steering apparatus 100 according to the present disclosure. As shown, a downhole drilling assembly 20 drills a borehole 12 penetrating an earth formation. The assembly 20 is operationally connected to a drillstring 22 using a suitable connector 21. In turn, the drillstring 22 is operationally connected to a rotary drilling rig 24 or other known type of surface drive.

The downhole assembly 20 includes a control assembly 30 having a sensor section 32, a power supply section 34, an electronics section 36, and a downhole telemetry section 38. The sensor section 32 has directional sensors, such as accelerometers, magnetometers, and inclinometers, which can be used to indicate the orientation, movement, and other parameters of the downhole assembly 20 within the borehole 12. This information, in turn, can be used to define the borehole's trajectory for steering purposes. The sensor section 32 can also have any other type of sensors used in Measurement-While-Drilling (MWD) and Logging-While-Drilling (LWD) operations including, but not limited to, sensors responsive to gamma radiation, neutron radiation, and electromagnetic fields.

The electronics section 36 has electronic circuitry to operate and control other elements within the downhole assembly 20. For example, the electronics section 46 has downhole processor(s) (not shown) and downhole memory (not shown). The memory can store directional drilling parameters, measurements made with the sensor section 32, and directional drilling operating systems. The downhole processor(s) can process the measurement data and telemetry data for the various purposes disclosed herein.

Elements within the downhole assembly 20 communicate with surface equipment 28 using the downhole telemetry section 28. Components of this telemetry section 38 receive and transmit data to an uphole telemetry unit (not shown) within the surface equipment 38. Various types of borehole telemetry systems can be used, including mud pulse systems, mud siren systems, electromagnetic systems, angular velocity encoding, and acoustic systems.

The power supply section 34 supplies electrical power necessary to operate the other elements within the assembly 20. The power is typically supplied by batteries, but the batteries can be supplemented by power extracted from the drilling fluid by way of a power turbine, for example.

During operation, a drill bit 40 is rotated, as conceptually illustrated by the arrow $R_B$. The rotation of the drill bit 40 is imparted by rotation $R_D$ of the drillstring 22 at the rotary rig 24. The speed (RPM) of the drillstring rotation $R_D$ is typically controlled from the surface using the surface equipment 28. Additional rotation to the drill bit 40 can also be imparted by a drilling motor (not shown) on the drilling assembly 20.

During operation, the drilling fluid system 26 pumps drilling fluid or "mud" from the surface downward and through the drillstring 22 to the downhole assembly 20. The mud exits through the drill bit 40 and returns to the surface via the borehole annulus. Circulation is illustrated conceptually by the arrows 14.

To directionally drill the advancing borehole 12 with the downhole assembly 20, the control assembly 30 is operated to change delivery of a portion of the flow of the fluid (circulated drilling mud) to the rotating steering apparatus 100 having multiple directional devices or directors 150*a-c*. Although disclosed herein as using the fluid flow through the apparatus 100 to direct the assembly 20, other arrangements can be used. For example, a separate hydraulic system can be used on the assembly 20 that is sealed from drilling fluids, and the control assembly 30 can direct that hydraulic fluid to move the directors 150*a-c*.

The apparatus 100 rotates with the drill string 22 and/or with a drilling motor (not shown) in rotating of the drill bit 40. For instance, the apparatus 100 may rotate at the same rate as the drillstring 22. Of course, the apparatus 100 can be used with a downhole drilling motor (not shown) disposed uphole of the apparatus 100. In this situation, the apparatus 100 can rotate at the output speed of the motor if the drillstring is not rotating, at the output speed of the drillstring 22 if the motor is clutched or not present, or at the combined output of the drillstring 22 and motor if both are rotating. Accordingly, the apparatus 100 can generally be said to always rotate at drill bit speed.

By operating the multiple directors 150*a-c*, the steering apparatus 100 steers the advancing borehole 12 using active deflection as the apparatus 100 rotates. During operation, for example, the control assembly 30 controls the flow of fluid through the downhole assembly 20 and delivers portions of the fluid to the directional devices 150*a-c* of the steering apparatus 100. Due to the rotation of the apparatus 100, the control assembly 30 can change delivery of the fluid to each of the multiple directors 150*a-c* either independently, cyclically, consecutively, together, or the like to alter the direction of the steering apparatus 100 as it advances the borehole 12. In turn, the directional devices 150*a-c* then use the pressure applied from the delivered flow to periodically extend/retract relative to the drill bit's rotation $R_B$ to define the trajectory of the advancing borehole 12.

The extension/retraction of the directional devices 150*a-c* can be coordinated with the orientation of the drilling assembly 20 in the advancing borehole 12 to control the trajectory of drilling, drill straight ahead, and enable proportional dogleg control. To do this, the control assembly 30 can be controlled using orientation information measured by the sensor section 32 cooperating with control information stored in the downhole memory of the electronics section 36 to direct the trajectory of the advancing borehole 12. In the end, the extension/retraction of the directional devices 150*a-c* disproportionately engages the drill bit 40 against a certain side in the advancing borehole 12 for directional drilling.

Figure 1B:
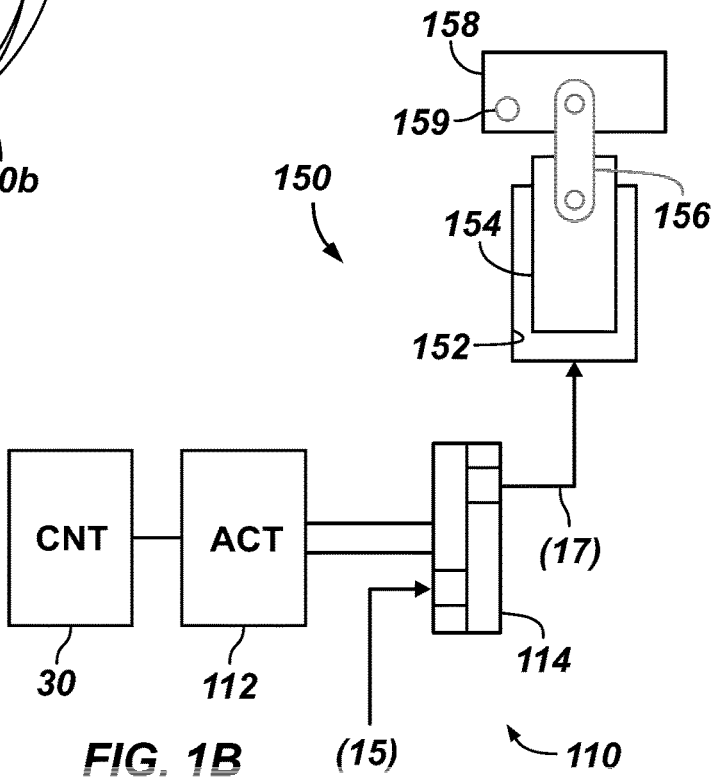

Features of the steering apparatus 100 are schematically shown in more detail in FIG. 1B. A local controller 110 includes an actuator 112 and a valve 114 and connects to the sensors and power source of the control assembly 30. The directional device 150—only one of which is schematically shown here—includes a piston chamber 152, a piston 154, a linkage 156, and a pad 158 disposed on the apparatus 100 to rotate therewith. The directional device 150 is operable to pivot its pad 158 about a pivot point 159 between an extended condition and a retracted condition relative to the apparatus 100.

In one arrangement, one local controller 110 can connect to all of the directional devices 150 on the apparatus 100. In an alternative arrangement, each directional device 150 can have its own local controller 110. In this alternative arrangement, each local controller 110 can operate its one directional device 150 independent of the others. As the steering apparatus 100 of FIGS. 1A-1B operates to steer drilling during continuous rotation, which can be up to 300-rpm with peaks much higher of about 600-rpm, each local controller 110 can then be operated to extend its pad 158 at the same target position, synchronous to the drill string's rotation. Meanwhile, the rotary position of each local controller 110 is determined by the sensors of the control system 30.

To extend the pad 158, the actuator 112 actuates the valve 114 and controls fluid communication of flow 15 as piston flow 17 to the piston chamber 152. For example, the valve 114 in a first condition directs communicated the flow 15 as piston flow 17 to the piston chamber 152 to push the piston 154 and pivot the pad 158 about its pivot point 159 toward the extended condition. By contrast, the valve 114 in a second condition does not communicate the flow 15 as piston flow 17 to the piston chamber 152 so the piston 154 and the pad 158 can retract toward the retracted condition. The flow 15 can be tool flow communicated through a bore 16 of the apparatus 100 or can be dedicated hydraulic fluid flow communicated from a hydraulic system 16' of the apparatus 100.

The retraction of the pad 158 may simply occur by pushing of the borehole wall against the pad 158 in the absence of directed piston flow 17. Vents (not shown) in the piston chamber 152 may allow fluid to vent out to the borehole to allow the piston 154 to retract. Additionally or in the alternative, spring returns (not shown in FIG. 1B) or the like could be used for the pistons 154, pads 158, or directional devices 150 to retract the pistons 154 when not energized with piston flow 17. In fact, such spring returns may be necessary in some implementations.

In general, the valve 114 can be a linear or rotary type of valve to selectively communicate the flow 15 as piston flow 17. The linear type valve can have controlled venting of the communicated fluid and can be configured to rapidly move a 3-way, 2-position valve element to supply and vent drilling fluid to and from the actuator's piston 76. As shown in FIG. 1B, the valve 114 can be a rotary type valve with adjacent disks movable relative to one another. This rotary disk valve 114 may be 2-way (ON-OFF), but may stop at any point throughout one rotation to provide a proportionate amount of flow.

As will be appreciated, the steering apparatus 100 can use a number of different ways to energize and relieve the pistons, and many different valve and actuator arrangements can be used.

Given the above description of the drilling system 10 and steering apparatus 100, discussion now turns to embodiments of the steering apparatus 100 to achieve directional drilling.

Figure 2A:
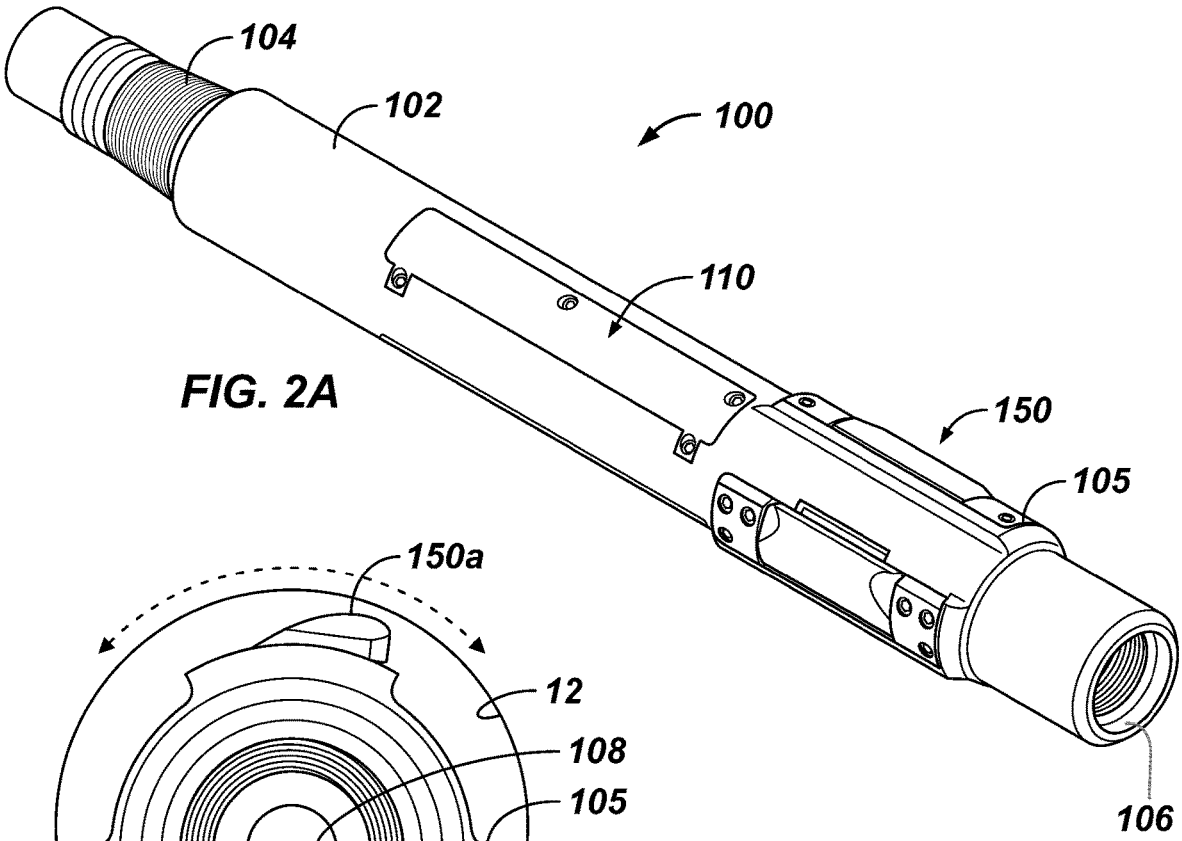
FIGS. 2A-2B illustrate the steering apparatus in perspective and end views.
Figure 2B:
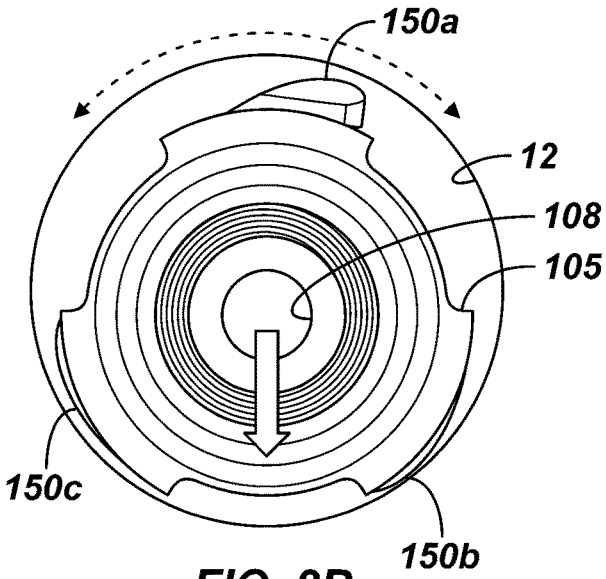

FIG. 2A illustrates a perspective view of portion of a steering apparatus 100 for the drilling assembly (20) according to the present disclosure. As already noted, the steering apparatus 100 of the drilling assembly (20) is disposed on a drillstring (22) for deviating a borehole advanced by the drill bit (40). Further details of the steering apparatus 100 are provided in the end-view of FIG. 2B.

The apparatus 100 has a housing or drill collar 102 with a through-bore 108 for drilling fluid. The drill collar 102 couples at an uphole end 104 (with pin thread) to uphole components of the assembly (20), such as control assembly (30), stabilizer, other drill collar, drillstring (22), or the like. The drill collar 102 couples at a downhole end 106 (with box thread) to downhole components of the assembly (20), such as a stabilizer, other drill collar, the drill bit (40), or the like. Multiple directional devices or directors 150 are disposed on the housing 102 near the end (106), and the directional devices 150 is associated with one device controller 110 or with its own device controller 110 also disposed on the housing 102. The directional devices 150 can be arranged on multiple sides of the housing 102 (either symmetrically or asymmetrically), and they can be disposed at stabilizer ribs 105 or other features on the housing 102.

Preferably, the arrangement is symmetrical or uniform, which simplifies control and operation of the apparatus 100, but this is not strictly necessary. As shown here in FIG. 2B, for example, the steering apparatus 100 includes three directors 150*a-c* arranged at about every 120-degrees. In general, more or less devices 150 can be used.

Figure 3A:
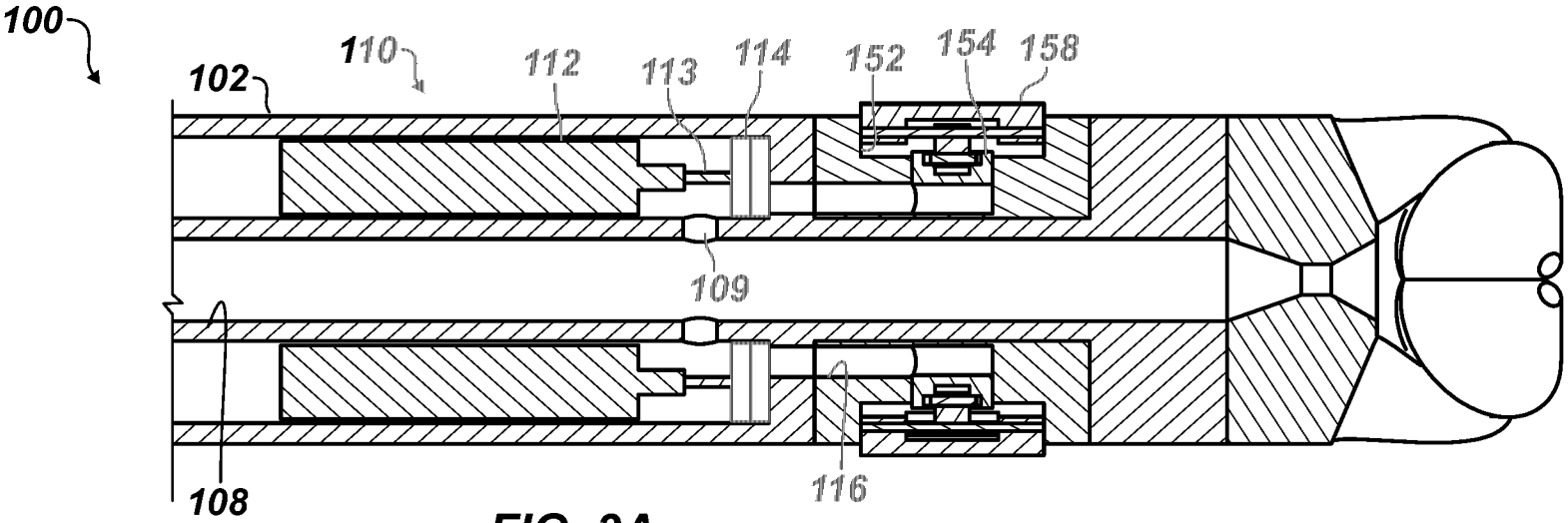
FIGS. 3A-3B illustrate the steering apparatus in cross-sectional and end-sectional views.
Figure 3B:
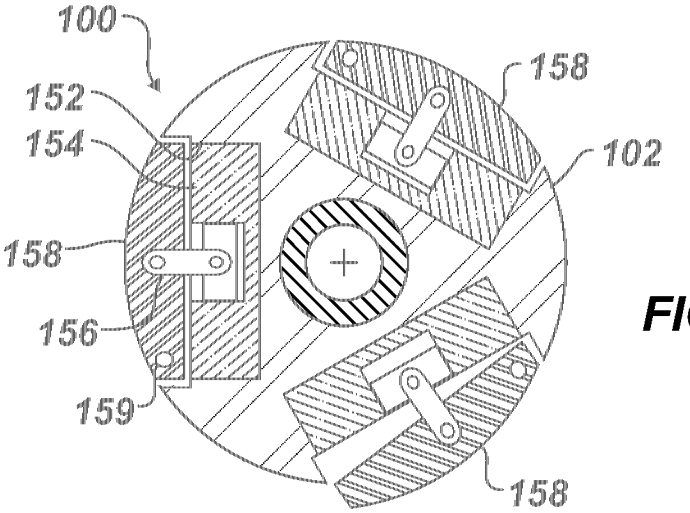

FIGS. 3A-3B show the apparatus 100 in additional detail in a cross-sectional view and an end-sectional view. Each of the directional devices 150 includes a pad 158 that rotates on a pivot point 159. For each directional devices 150, a piston 154 engages one end of a lever or linkage 156 connected to the pad 158. The piston 154 is alternatingly displaceable in the housing chamber 152 between extended and retracted conditions, and the interaction of the linkage 156 between the piston 154 and the pad 158 causes the pad 158 to pivot about the pivot point 159 and either extend away from the housing 102 or retract in toward the housing 102.

The pads 158 can have surface treatment, such as Tungsten Carbide hard facing, or other feature to resist wear. As shown, there may be no biasing element to retract the pads 158. Instead, the pads 158 may retract naturally under the rotation of the housing 102 in the wellbore. Additionally, vents (not shown) in the piston chambers 152 can vent drilling fluid from the chamber 152 to the borehole to allow the piston 154 to retract.

The housing 102 has external pockets to contain the local controllers 110 for each of the pads 158. As noted before, the local controller 110 includes the actuator 112 for actuating the valve 114 to control delivery of tool flow to the piston chamber 152. As shown, the housing 102 has an axial bore 108 along the housing's longitudinal axis communicating the drillstring (22) with the drill bit (40). Filtered ports 109 can communicate the internal flow in the axial bore 108 to one side of the valve 114 for the local controller 110 for each directional device 150. Depending on the state of the valve 114, a portion of the tool flow from the bore 108 can communicate via a channel to the piston chamber 152 for the piston 154. Again, although disclosed herein as using the flow through the bore 108 of the apparatus 100 to direct the directional devices 150, other arrangements can be used. For example, a separate hydraulic system (16': FIG. 1B) can be used that is sealed from drilling fluids, and the valves 114 can communication hydraulic fluid via a channel to the piston chamber 152 for the piston 154.

Figure 4A:
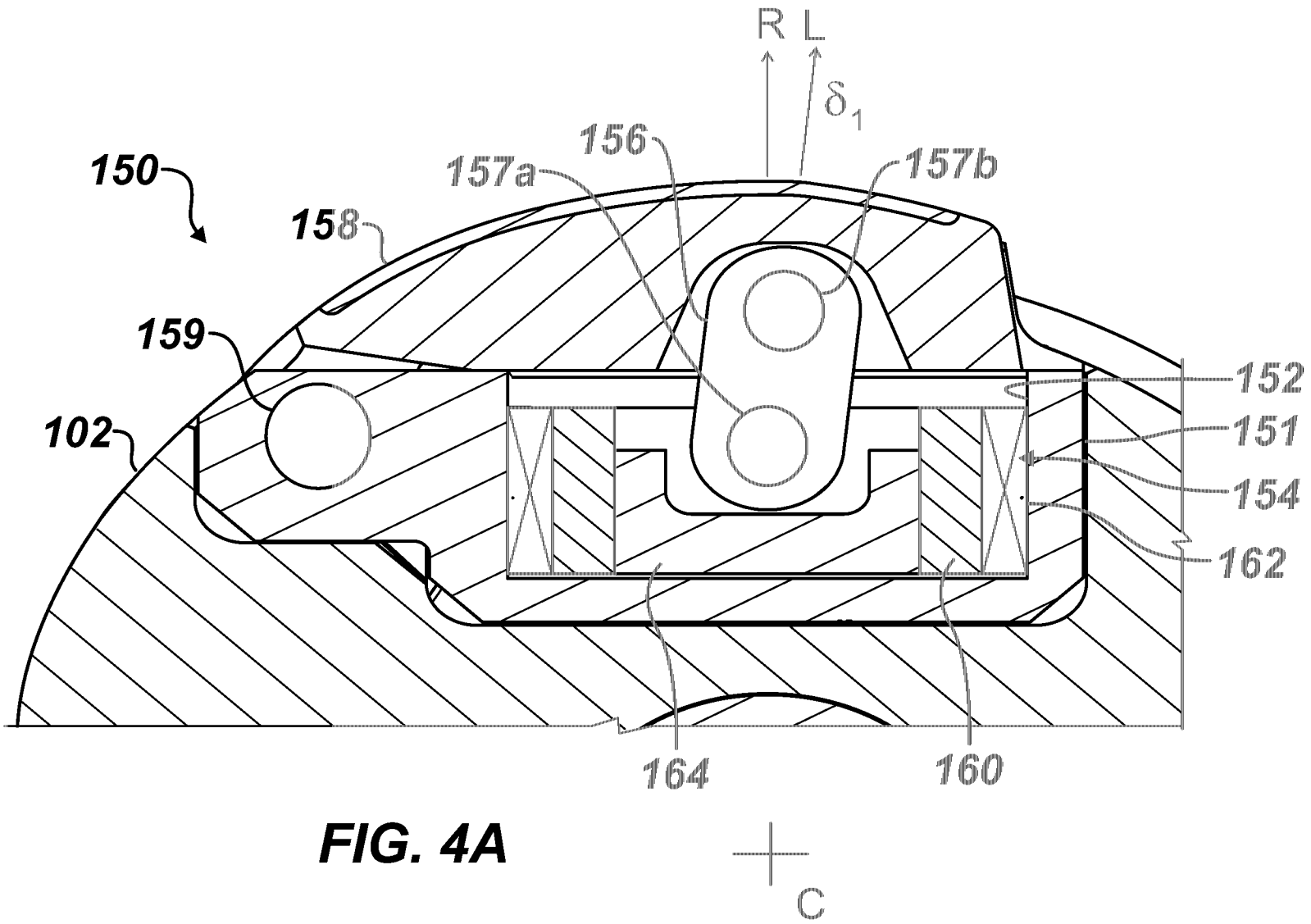
FIGS. 4A-4B illustrate two orthogonal cross-sections of a directional device of the steering apparatus in a retracted condition.
Figure 4B:
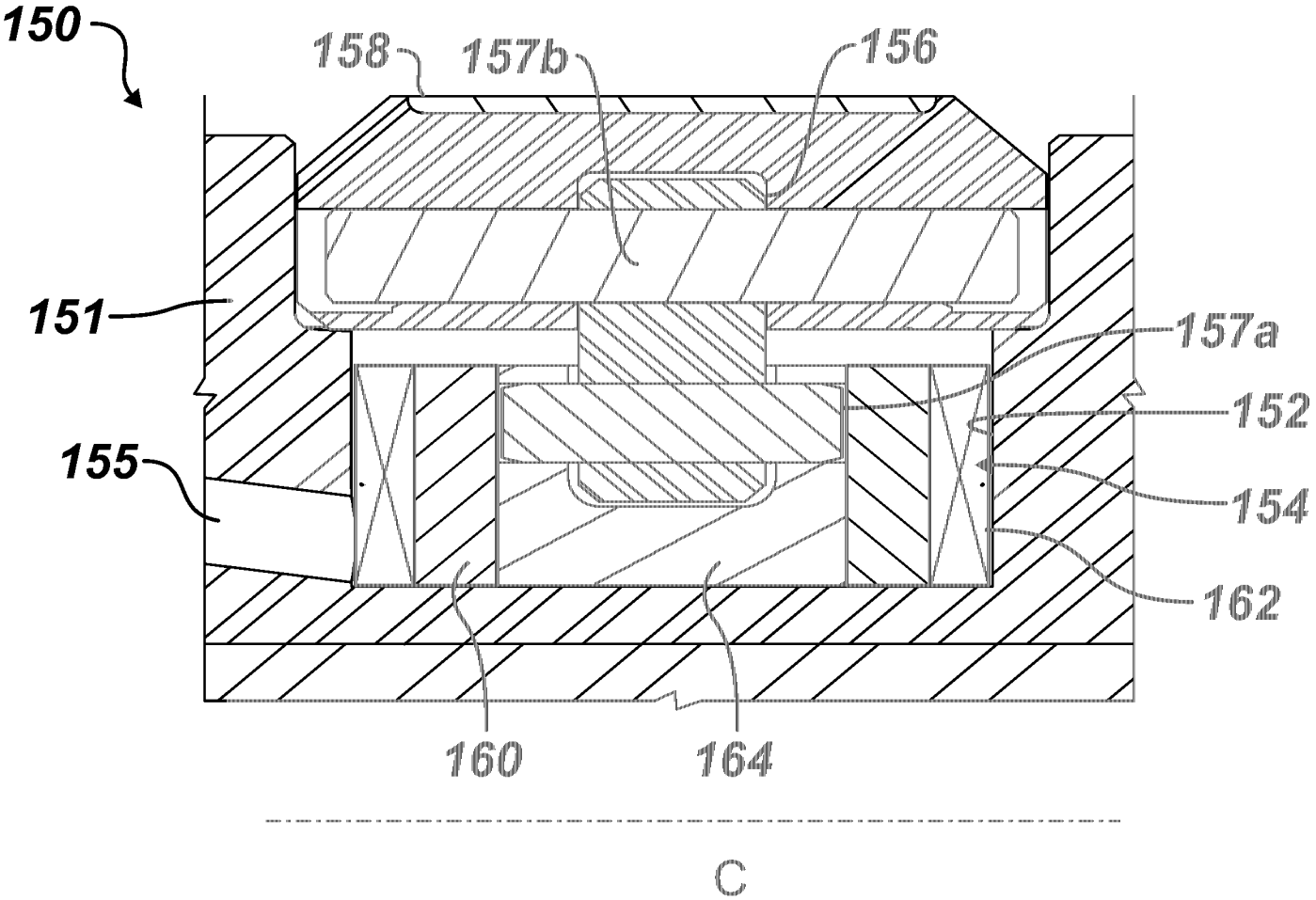
Figure 5:
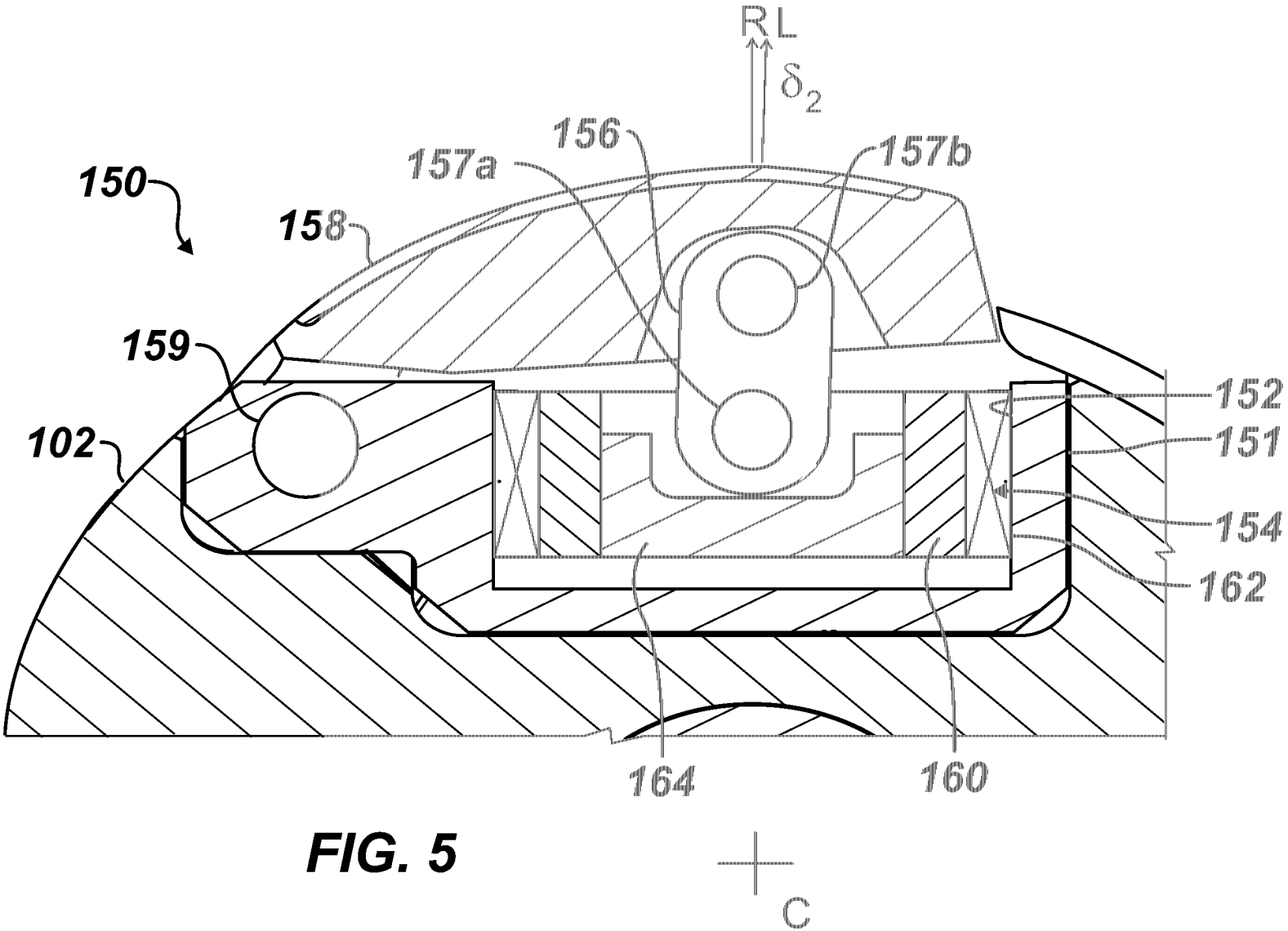
FIG. 5 illustrates a cross-section of the directional device of the steering apparatus in an extended condition.

Turning now to more details of the directional devices 150, discussion turns to FIGS. 4A-4B and 5. FIGS. 4A-4B illustrate two orthogonal cross-sections of a directional device 150 of the steering apparatus in a retracted condition, while FIG. 5 illustrates a cross-section of the directional device 150 in an extended condition.

As shown, the directional device 150 may include a module 151 that can removably position in a side pocket of the tool's housing (102). The module 151 can define the piston chamber 152 with a channel 155 for communicating adjacent the valve (114) in the tool's housing (102). The module 151 holds the piston 154, the pad 158, the linkage 156, and the pivot point 159.

The module 151 provides versatility to the directional device 150. For example, a given housing (102) of the apparatus (100) can be configured for drilling more than one borehole size, such as 8⅜, 8½, and 8¾ in. borehole sizes. However, different modules 151 with pads 158 and the like of different lengths and dimensions can be used with the same housing (102) to adapt to the different borehole sizes to be drilled. This gives some versatility and modularity to the assembly.

The piston 154 includes a piston body 160 with a seal 162 disposed thereabout. The seal 162 slideably engages an inside wall of the chamber 152 and can form a metal-to-metal seal, although other types of seals can be used. Accordingly, the seal 162 can use any suitable sealing element. Vent(s) (not shown) in the chamber 152 may allow for venting of fluid from the chamber 152 to the borehole annulus, which can allow the piston 154 to retract in the chamber 152 and can clean the chamber 152 of debris. The venting can use one or more ports (not shown) in the chamber 152 that are always open to the borehole annulus.

The venting can also be achieved in a number of other ways. For example, a separate valve (not shown) can be used to vent the fluid from the chamber 152, or the same valve used for the inlet 108 can be used for venting.

In addition to the seal 162, the piston 154 can have a central socket 164 affixed in the outer piston body 160. The central socket 164 is connected to the linkage arm 156 and facilitates assembly and alignment of the components.

The piston 154 has a first linkage pin 157*a* connected to a first end of the linkage arm 156, and the pad 158 has a second linkage pin 157*b* connected to a second end of the linkage arm 156. The linkage pins 157*a-b* and the pad's pivot pin 159 are parallel to a center C of rotation of the housing (102), and the linkage 156 lies in a plane perpendicular to the center C of rotation. To facilitate rotation, bushings (not shown) can be used with the linkage pins 157*a-b* and the main pivot pin 159.

As best shown in FIGS. 4A and 5, the piston 154 is movable radially between first and second positions in a radial direction R relative to the center C of rotation of the housing (102). The linkage 156 is movable with the piston 154 and rotates towards the pivot point 159 from a first angular orientation (FIG. 4A) at the piston's first position to a second angular orientation (FIG. 5) at the piston's second position. The second angular orientation (FIG. 5) is more aligned with radial direction R than the first angular orientation (FIG. 4A). Therefore, as shown in FIGS. 4A and 5, the axis L of the linkage 156 rotates from a wider offset $\delta_1$ in FIG. 4A to a narrower offset $\delta_2$ in FIG. 5 when the pad 158 is extended by the piston 154. In other words, the first pivot pin 157*a* is translated radially in the radial direction R with the piston 154, while the second pivot pin 157*b* is rotated about the pivot point 159.

The arrangement with the linkage 156 provides two revolute joints between the piston 154 and pad 158. This reduces wear at the interface between the pad 158 and piston 154. The linkage 156 also allows the piston 154 to travel in a straight, radial direction in its direct (rather than curved) bore for the chamber 152 that is arranged in the radial direction R from the side of the housing (102). In this way, the linkage 156 provides flexibility in the load so that side loads, tilting, and the like are less likely to affect the movement on the piston 154.

Moreover, complexity is reduced, and the piston's motion is more efficient. The piston 154 can also be considerably thin and can better fit in the fixed radial envelope available about the housing (102). Finally, the piston 154 can move further in distance, which improves directional performance. The actual displacement of the piston 154 and the actual amount of rotation about the pivot 159 would depend on the desired deflection for the tool, the overall diameter of the tool, and other factors.

Figure 6B:
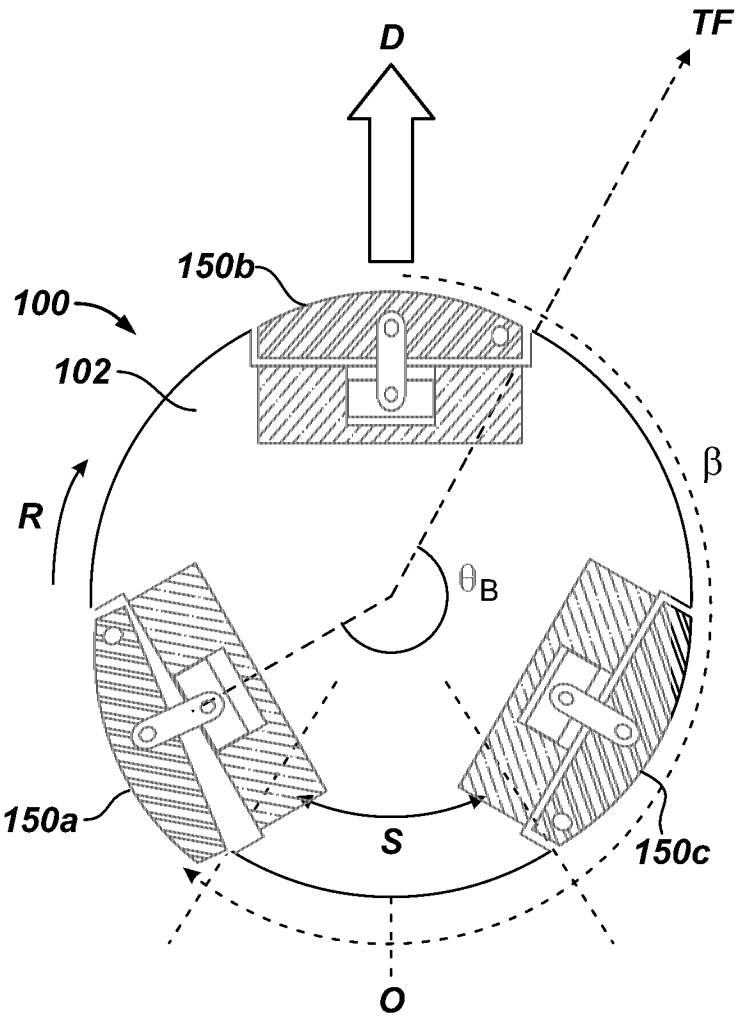
FIGS. 6A-6B schematically illustrate end views of the steering apparatus during operation.
Figure 6A:
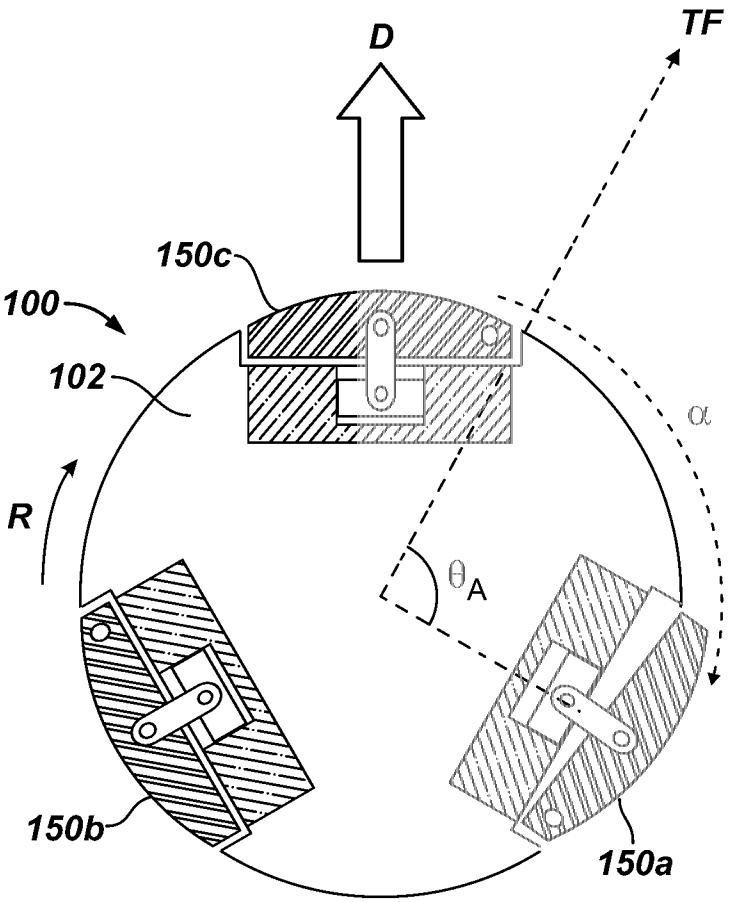

Having an understanding of the steering apparatus 100, discussion now turns to operation of the apparatus 100. FIGS. 6A-6B illustrate schematic end views of the steering apparatus 100 in two states of operation. As noted herein, the steering apparatus 100 has multiple directional devices or directors 150*a-c* disposed around the housing 102, such as the three directors 150*a-c* depicted here.

As expressed herein, the directional device 150150*a-c* rotate with the housing 102, and the housing 102 rotates with the drillstring (22). As the drill bit (40) rotates with the housing 102 and the drillstring (22), the transverse displacement of the directional devices 150*a-c* can then displace the longitudinal axis of the housing 102 relative to the advancing borehole. This, in turn, tends to change the trajectory of the advancing borehole. To do this, the independent extensions/retractions of the directional devices 150*a-c* are timed relative to a desired direction D to deviate the apparatus 100 during drilling. In this way, the apparatus 100 operates to push the bit (40) to change the drilling trajectory.

FIGS. 6A-6B show one of the directional devices 150*a* extended therefrom during a first rotary orientation (FIG. 6A) and then during a later rotary orientation (FIG. 6B) after the housing 102 has rotated. Because the steering apparatus 100 is rotated along with the drillstring (22) and/or with a mud motor (not shown) disposed above the apparatus 100, the operation of the steering apparatus 100 is cyclical to substantially match the period of rotation of the drillstring (22) and/or mud motor.

As the steering apparatus 100 rotates, the orientation of the directional devices 150*a-c* is determined by the control assembly (30), position sensors, toolface (TF), etc. When it is desired to deviate the drill bit (40) in a direction towards the direction given by arrow D, then it is necessary to extend one or more of the directional devices 150*a-c* as they face the opposite direction O. The control assembly (30) calculates the orientation of the diametrically opposed position O and instructs the actuators for the directional devices 150*a-c* to operate accordingly. Specifically, the control assembly (30) may produce the actuation so that one directional device 150*a* extends at a first angular orientation ($\alpha$ in FIG. 7A) relative to the desired direction D and then retracts at a second angular orientation ($\beta$ in FIG. 7B) in the rotation R of the steering apparatus 100.

Because the directional device 150*a* is rotating in direction R with the housing 102, orientation of the directional device 150*a* relative to a reference point is determined using the toolface (TF) of the housing 102. This thereby corresponds to the directional device 150*a* being actuated to extend starting at a first angular orientation $\theta_A$ relative to the toolface (TF) and to retract at a second angular orientation $\theta_A$ relative to the toolface (TF). As will be appreciated, the toolface (TF) of the housing 102 can be determined by the control assembly (30) using the sensors and techniques discussed previously.

Because the directional device 150*a* does not move instantaneously to its extended condition, it may be necessary that the active deflection functions before the directional device 150*a* reaches the opposite position O and that the active deflection remains active for a proportion of each rotation R. Thus, the directional device 150*a* can be extended during a segment S of the rotation R best suited for the directional device 150*a* to extend and retract relative to the housing 102 and engage the borehole to deflect the housing 102.

The RPM of the housing's rotation R, the drilling direction D relative to the toolface (TF), the operating metrics of the directional device 150*a*, and other factors involved can be used to define the segment S. If desired, it can be arranged that the angles $\alpha$ and $\beta$ are equally-spaced to either side of the position O, but because it is likely that the directional device 150*a* will extend gradually (and in particular more slowly than it will retract) it may be preferable that the angle $\beta$ is closer to the position O than is the angle $\alpha$.

Of course, the steering apparatus 100 as disclosed herein has the additional directional devices 150*b-c* arranged at different angular orientations about the housing's circumference. Extension and retraction of these additional directional devices 150*b-c* can be comparably controlled in conjunction with what has been discussed with reference to FIGS. 6A-6B so that the control assembly (30) can coordinate multiple retractions and extensions of the several directors 150*a-c* during each of (or one or more of) the rotations R. Thus, the displacement of the housing 102 and directional devices 150*a-c* can be timed with the rotation R of the drillstring (22) and the apparatus 50 based on the orientation of the steering apparatus 100 in the advancing borehole. The displacement can ultimately be timed to direct the drill bit (40) in a desired drilling direction D and can be performed with each rotation or any subset of the rotations.

Drilling straight ahead can be achieved along with proportional control. Drilling straight ahead can involve varying the target direction D over each rotation or can involve switching the system off (i.e., having each of the directional devices 150*a-c* retracted). Proportional control can be achieved by pushing 1, 2 or 3 times per rotation or by varying the arc over which each directional device 150*a-c* is extended. Moreover, the disclosed system can have all directional devices 150*a-c* retracted (or all extended) at the same time. Retraction of all devices 150*a-c* can be used in advancing the borehole along a straight trajectory at least for a time. Extension of all of the directional devices 150*a-c* can provide reaming or stabilizing benefits during drilling.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the disclosed subject matter. Therefore, it is intended that the disclosed subject matter include all modifications and alterations to the full extent that they come within the scope of the disclosed embodiments or the equivalents thereof.

What is claimed is:

1. An apparatus disposed on a drillstring for deviating a borehole advanced by a drill bit, the apparatus comprising:

a housing disposed on the drillstring, the housing having a center of rotation about which the housing rotates and transferring the rotation to the drill bit, the housing having a bore communicating fluid from the drillstring to the drill bit;

at least one director disposed on the housing to rotate therewith, the at least one director at least including a piston movable in a chamber, a pad pivotable about a fixed pivot point between an extended condition and a retracted condition relative to the housing, and a linkage arm pivotably connected between the piston and the pad; and at least one actuator disposed on the housing in fluid communication with communicated fluid, the at least one actuator operable at least between a first condition directing the communicated fluid to the chamber of the at least one director and a second condition at least permitting the at least one director to retract toward the retracted condition.

2. The apparatus of claim 1, wherein the at least one director comprises a module removably positionable in a side of the housing, the module defining the chamber, the module defining a channel for communicating the chamber with the at least one actuator, the module holding the piston, the pad, the linkage arm, and the fixed pivot point.

3. The apparatus of claim 1, wherein the piston comprises a seal disposed about the piston and slideably engaging an inside wall of the chamber.

4. The apparatus of claim 3, wherein the seal comprises a metal sealing element slideably engaging metal on the inside wall of the chamber.

5. The apparatus of claim 3, wherein the piston comprises a central socket affixed in a piston body, the central socket being connected to the linkage arm, the piston body having the seal disposed thereabout.

6. The apparatus of claim 1, wherein the piston comprises a first linkage pin connected to a first end of the linkage arm; and wherein the pad comprises a second linkage pin connected to a second end of the linkage arm.

7. The apparatus of claim 6, wherein the piston is movable between first and second positions in a radial direction relative to the center of rotation of the housing; and wherein the linkage arm movable with the piston rotates relative to the fixed pivot point from a first angular orientation at the first position to a second angular orientation at the second position, the second angular orientation being more aligned with the radial direction than the first angular orientation.

8. The apparatus of claim 6, wherein the first linkage pin is translated radially in a radial direction with the piston; and wherein the second linkage pin is rotated about the fixed pivot point.

9. The apparatus of claim 6, wherein the first and second linkage pins and the fixed pivot point are parallel to the center of rotation of the housing; and wherein the linkage lies in a plane perpendicular to the center of rotation.

10. The apparatus of claim 1, wherein the housing has the rotation imparted thereto by the drillstring, by a motor disposed on the drillstring, or by both the drillstring and the motor.

11. The apparatus of claim 1, further comprising a controller operating the at least one actuator.

12. The apparatus of claim 11, wherein the controller is configured to determine angular orientation of the at least one director relative to a desired trajectory for the borehole and is configured to translate the determined orientation to actuations of the at least one actuator to deviate the borehole toward the desired trajectory.

13. The apparatus of claim 1, wherein the chamber defines a vent to communicate with the borehole, the vent venting the communicated fluid of the at least one director and at least permitting the at least one director to retract toward the retracted condition.

14. The apparatus of claim 1, wherein the at least one actuator comprises:

a valve member rotatable relative to an inlet port and an outlet port; and a drive operable to rotate the valve member, the valve member rotated in a first orientation directing the communicated fluid, the valve member rotated in a second orientation closing off the communication of fluid.

15. The apparatus of claim 14, wherein the inlet port is disposed in fluid communication with the communicated fluid from the bore of the housing or from a hydraulic source.

16. A drilling method, comprising:

advancing a borehole with a drill bit on a rotating drilling assembly coupled to a drillstring by transferring rotation about a center of the rotating drilling assembly to the drill bit;

controlling fluid in the rotating drilling assembly by operating at least one actuator disposed on the rotating drilling assembly;

moving a piston away from the center of rotation of the rotating drilling assembly using the controlled fluid from the at least one operated actuator, the piston disposed on the rotating drilling assembly and being rotatable therewith about the center of rotation;

transferring the movement of the piston with a linkage arm to a pad, the pad and the linkage arm disposed on the rotating drilling assembly and being rotatable therewith about the center of rotation;

pivoting the pad about a fixed pivot point on the rotating drilling assembly with the transferred movement from the linkage arm; and deviating the advancing borehole with the rotating drilling assembly using the pivoted pad.

17. The method of claim 16, wherein operating the at least one actuator and controlling the fluid comprises:

measuring an angular rate of the rotating drilling assembly as it rotates;

measuring orientation of the rotating drilling assembly as it rotates relative to the borehole;

taking a desired trajectory for the borehole; and translating the desired trajectory into the actuation of the at least one actuator based on the angular rate and the orientation of the rotating drilling assembly.

18. The method of claim 16, wherein controlling the fluid using the at least one operated actuator comprises directing the controlled fluid through the rotating drilling assembly to the piston by operating a valve.

19. The method of claim 18, wherein directing the controlled fluid through the rotating drilling assembly to the piston by operating the valve comprises communicating the valve with the communicated fluid from a bore of the rotating drilling assembly or from a hydraulic source.

20. The method of claim 18, wherein operating the valve comprises:

rotating a valve member relative to an inlet port and an outlet port with a drive operable to rotate the valve member, the valve member rotated in a first orientation directing the controlled fluid, the valve member rotated in a second orientation closing off the communication of the controlled fluid.

21. The method of claim 16, wherein transferring the movement of the piston with the linkage arm to the pad disposed on the rotating drilling assembly comprises transferring the movement of the piston with a first linkage pin connected to the piston at a first end of the linkage arm to a second linkage pin connected to the pad at a second end of the linkage arm.

22. The method of claim 21, wherein transferring the movement of the piston with the linkage arm to the pad disposed on the rotating drilling assembly comprises:

moving the piston between first and second positions in a radial direction relative to the center of rotation of the rotating drilling assembly; and rotating the linkage arm relative to the fixed pivot point from a first angular orientation at the first position to a second angular orientation at the second position, the second angular orientation being more aligned with radial direction than the first angular orientation.

23. The method of claim 21, wherein transferring the movement of the piston with the linkage arm to the pad disposed on the rotating drilling assembly comprises translating the first linkage pin in a radial direction with the piston and rotating the second linkage pin about the pivot point.

24. The method of claim 16, wherein transferring the rotation of the rotating drilling assembly to the drill bit comprises imparting the rotation to the rotating drilling assembly by the drillstring, by a motor disposed on the drillstring, or by both the drillstring and the motor.

25. The method of claim 16, wherein controlling the fluid through the rotating drilling assembly by operating the at least one actuator disposed on the rotating drilling assembly comprises determining angular orientation of the pad relative to a desired trajectory for the borehole and translating the determined orientation to the actuations of the at least one actuator to deviate the borehole toward the desired trajectory.

26. The method of claim 16, comprising venting the communicated fluid of the piston and at least permitting the pad to retract toward the retracted condition.

* * * * *